US005509850A

United States Patent [19]

Morioka et al.

[11] Patent Number: 5,509,850

[45] Date of Patent: Apr. 23, 1996

[54] POLISHING APPARATUS

[75] Inventors: Izuru Morioka; Kiyoshi Yui, both of Tokyo, Japan

[73] Assignee: Nihon Micro Coating Co., Ltd., Japan

[21] Appl. No.: 265,281

[22] Filed: Jun. 24, 1994

[30] Foreign Application Priority Data

Dec. 13, 1993 [JP] Japan ..... 5-341224

[51] Int. Cl.[6] ..... B24B 9/00; B24B 5/00; B24B 21/00

[52] U.S. Cl. ..... 451/168; 451/173; 451/304

[58] Field of Search ..... 451/168, 174, 451/162, 163, 164, 166, 304, 310, 489, 119, 120, 121, 124, 150, 173

[56] References Cited

U.S. PATENT DOCUMENTS

| | | | |
|---|---|---|---|
| 2,726,491 | 5/1955 | Smedley | 451/168 |
| 3,116,572 | 1/1964 | Dreiling | 451/168 |
| 3,800,475 | 4/1974 | Partal | 451/168 |
| 3,853,499 | 12/1974 | Larson et al. | 451/121 |
| 4,186,527 | 2/1980 | Hausermann et al. | 451/163 |
| 4,528,776 | 7/1985 | Estabrok | 451/150 |
| 4,796,387 | 1/1989 | Johnson | 451/168 |
| 4,951,420 | 8/1990 | Sorg | 451/162 |
| 5,027,560 | 7/1991 | Coburn et al. | 451/166 |
| 5,403,227 | 4/1995 | Franklin et al. | 451/168 |

*Primary Examiner*—Bruce M. Kisliuk
*Assistant Examiner*—Dona C. Edwards
*Attorney, Agent, or Firm*—Majestic, Parsons, Siebert & Hsue

[57] ABSTRACT

An apparatus has a polishing head for polishing an object such as a semiconductor wafer by using a polishing tape stretched between two guide rollers. The head can be rotated so as to change the angle of contact between the tape and the object and also undergo a reciprocating motion perpendicular to the direction of supply of the tape. For this purpose, the apparatus includes a first plate attached to the head and a second plate supported parallel to each other and in motion-communicating relationship by means of rods which are attached to the first plate and penetrate the second plate. The second plate is attached to the rotary shaft of a direct drive motor for causing oscillatory angular motion. This rotary shaft is tubular and an inner shaft for causing the oscillatory motion passes slidably therethrough.

7 Claims, 7 Drawing Sheets

POLISHING APPARATUS

BACKGROUND OF THE INVENTION

This invention relates to a polishing apparatus and, in particular, to a polishing apparatus with which a polishing tape can be used efficiently and contacted at an arbitrary angle to a surface being polished.

Edge surfaces of an object, such as a semiconductor wafer, are usually polished by rubbing them with a polishing pad or the like by using a coating slurry (or a loose abrasive) comprising abrasive grains and a solvent, just like its upper and lower main surfaces. If such a slurry is used, however, the liquid, such as water which is used, must be cleaned after the polishing process so as not to have any slurry left therein. If the slurry remains in the water, the slurry formed on the water surface may cause a device failure. Moreover, since such slurry is usually alkaline, the waste water after the polishing process cannot be discarded freely without a chemical treatment. If the waste water must be treated, furthermore, it adversely affects both the time and costs required for the process.

SUMMARY OF THE INVENTION

It is therefore an object of this invention to provide a polishing apparatus which does not require the use of a slurry.

It is another object of the invention to provide a polishing apparatus capable of polishing along edges of a target object at various angles.

It is a further object of the invention to provide a polishing apparatus which does not require any treatment of waste liquid after a polishing process therewith.

A polishing apparatus according to the present invention, with which the above and other objects can be accomplished, may be characterized as using a polishing tape and comprising a so-called direct drive motor having a rotary shaft with a throughhole along its axis of rotation, an inner shaft received in this throughhole so as to be slidable longitudinally therethrough, a first plate attached to one end of the inner shaft and protruding from the rotary shaft, a second plate attached perpendicularly to the rotary shaft, means for causing the inner shaft to move reciprocatingly through the rotary shaft, and means for connecting the first and second plates such that they can move towards or away from each other while remaining parallel to each other. At least two guide rollers are supported by the first plate for having the tape stretched therebetween to be pushed against the object to be polished. There may also be provided means for emitting a liquid such as water to the contact area between the tape and the object.

With an apparatus thus structured, the reciprocating motion of the inner shaft through the rotary shaft of the direct drive motor causes the tape to move transversely to the direction of its general motion. The angle of contact between the tape and the object can be controlled by the operation of the direct drive motor.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1B:
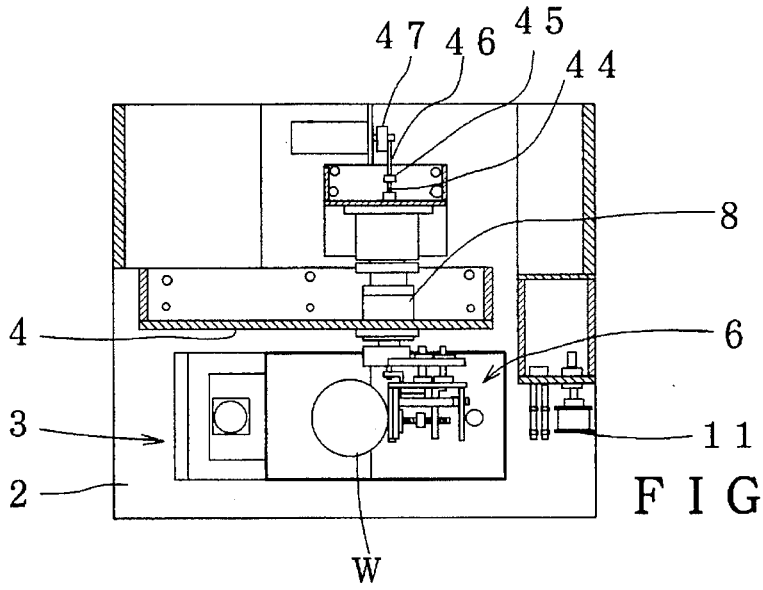
FIG. 1B is its sectional view taken along line 1B—1B of FIG. 1A;.
Figure 1A:
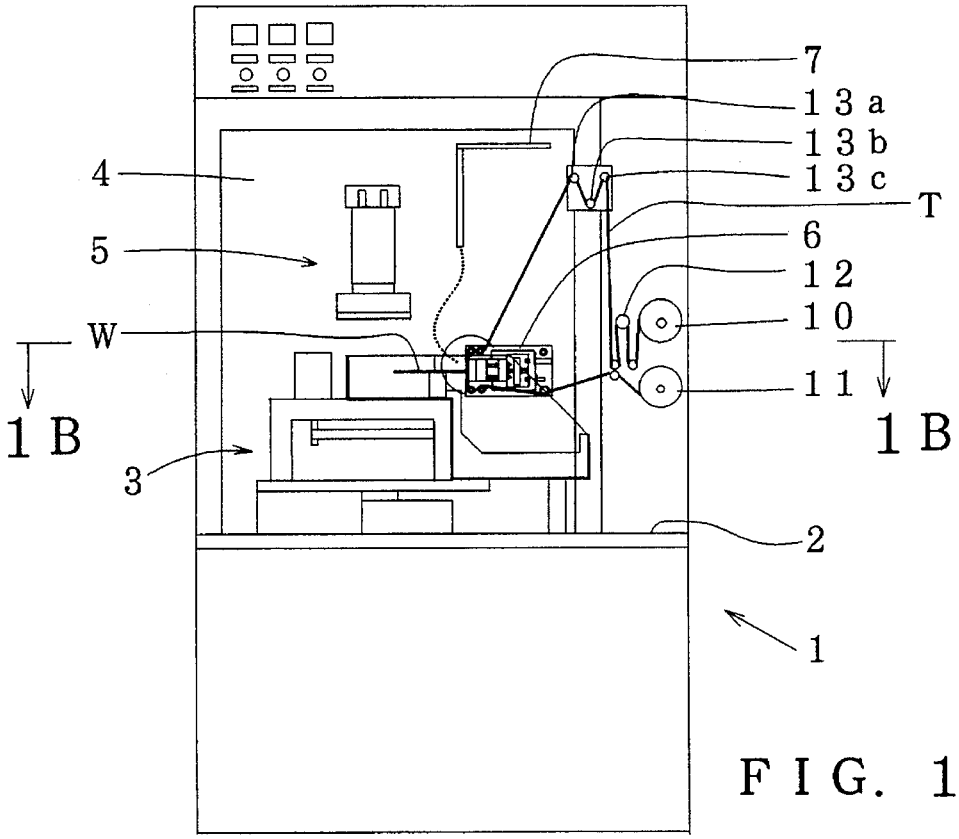
FIG. 1A is a front view of a polishing apparatus embodying the invention.

In FIGS. 1A and 1B, a polishing apparatus 1 embodying the present invention is shown as having mounted on a horizontal base plate 2 a mechanism 3 for horizontally moving and rotating an object to be polished (such as a wafer W). As will be explained more in detail later, this mechanism 3 is for horizontally moving a target object between a mounting position (shown in FIG. 2) and a polishing position and also for rotating it at the polishing position. A front plate 4 is mounted on the horizontal base plate 2 perpendicularly thereto, and a mounting device 5 for the target object and a polishing head 6 are mounted on the front plate 4. There is another supporting plate at one side of the base plate 2, supporting a supply roller 10, from which a polishing tape T is supplied, and a take-up roller 11 for taking it up. A guide roller 12 is disposed close to the supply roller 10 for supplying the tape T at a uniform constant speed. A group of three rollers 13*a*, 13*b* and 13*c* is provided at an elevated position for passing the tape T therearound before it is taken up by the take-up roller 11. These rollers 13*a*, 13*b* and 13*c* are for the purpose of preventing too much stress from becoming applied to the tape T when the polishing head 6 executes a linear reciprocating motion perpendicular to the front plate 4 as will be described below. For this reason, the positions of the rollers 13*a*, 13*b* and 13*c* are determined according to the mode of motion executed by the polishing head 6. A pipe 7 is also provided on the plate 4 for emitting a liquid such as water where the tape T contacts the object to be polished.

As shown in FIG. 1B, there is provided behind the front plate 4 a so-called direct drive motor 8 of a commercially available kind, characterized as being capable of rotating its rotary shaft continuously by a specified angle in either direction, as well as reciprocally or repeatedly between two specified angular positions. As will be described more in detail below, the rotary shaft (indicated by numeral 41 in FIGS. 4 and 5) of this motor 8 is tubular, having a hollow cylindrical interior, containing therein and therethrough a shaft (herein referred to as the inner shaft 44). One end of this inner shaft 44 is connected to the polishing head 6 and the other end is connected to a means for providing a reciprocating motion to be described below with reference to FIG. 5.

Figure 2A:
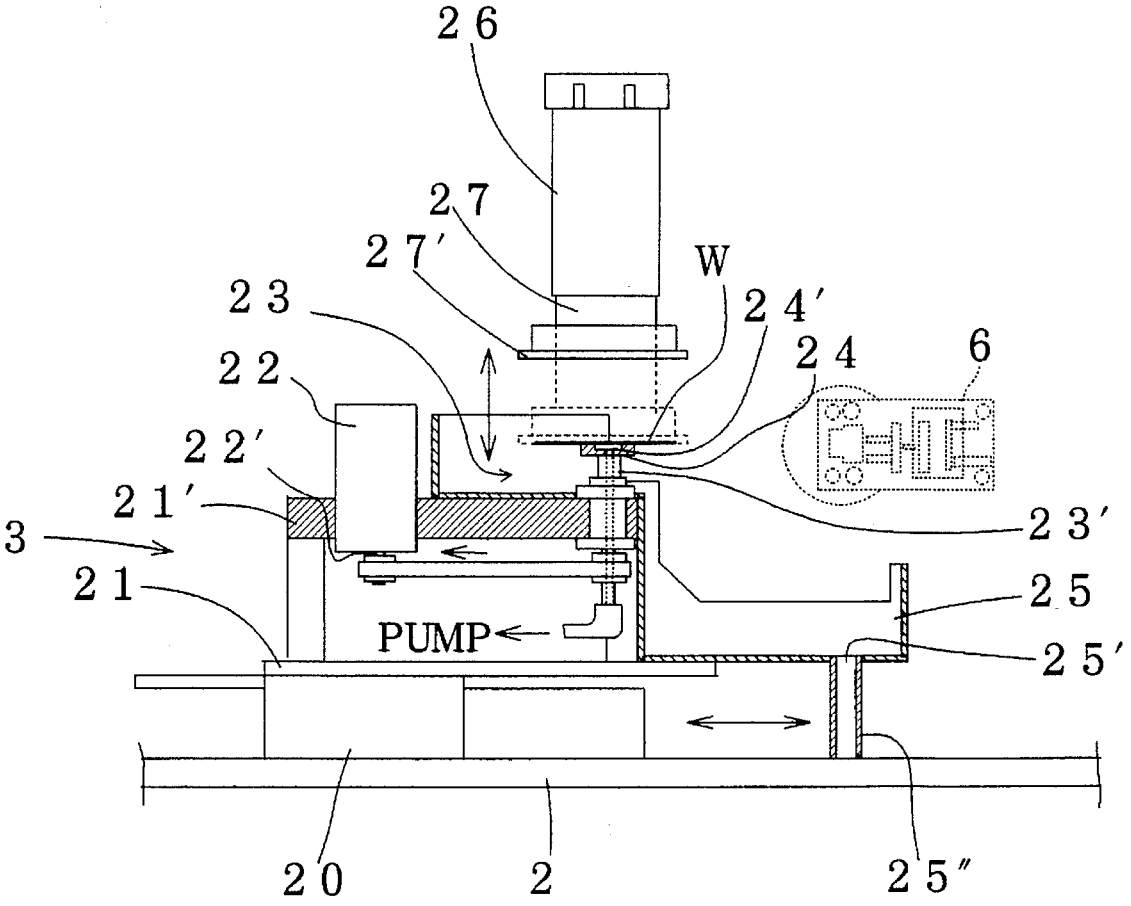
FIG. 2A is a partly sectional front view of a wafer-rotating mechanism for the apparatus of FIGS. 1A and 1B.
Figure 2B:
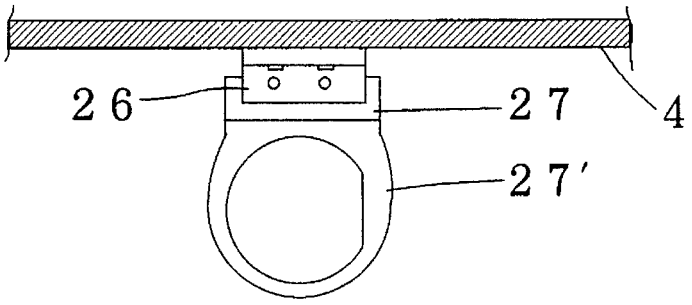
FIG. 2B is a plan view of its wafer-supporting portion.

As shown in FIGS. 2A and 2B, the mechanism 3 for moving the target object to be polished (again represented here as a wafer W) includes a horizontally moving device 20 and a rotating device 23. The horizontally moving device 20 is attached to the top of the base plate 2, and a base piece 21 is in turn attached to the top of the horizontally moving device 20. An air cylinder (not shown) is contained inside the horizontally moving device 20 such that the base piece 21 can be moved horizontally back and forth. The air cylinder, however, may be replaced by any other means such as cams, gears, belts and/or a motor capable of accurately moving the base plate 21 horizontally required above.

A frame 21" is affixed to the base piece 21. A wafer-rotating motor 22 with a vertically oriented rotary shaft 22' is disposed at one end on the upper surface of the frame 21", and the rotating device 23 with its vertically oriented rotary shaft 23' is mounted on the other end of the upper surface of the frame 21'. Both of these rotary shafts 22' and 23' are connected by a belt such that the rotary motion of the motor 22 is transmitted to the rotary shaft 23' of the rotating device 23.

The rotary shaft 23' of the rotating device 23 has an axially extending throughhole at its center with a wafer-holding disc 24 mounted on its upper end. The disc 24 has an indentation 24' formed at its center so as to communicate with this throughhole. The other end of the rotary shaft 23' is connected to a pump for evacuating air through the throughhole from the space inside the indentation 24' without interfering with the rotary motion of the shaft 23' such that a target object (such as a wafer W) can be maintained on the disc 24 by the negative pressure generated by the pump. In other words, the wafer W is rotated with the disc 24 as the shaft 23' is rotated by the motor 22. It is to be noted, however, that this wafer-rotating mechanism is useful only when the peripheries of a disc-shaped object such as a wafer are polished while the object is rotated. The motor 22 and the other wafer-rotating components described above are not indispensable to the present invention if there is no need to keep rotating the object while it is being polished.

An enclosure 25 is provided for enclosing the rotating device 23, and there is a drain tube 25" communicating with a drain hole 25' and extending to the bottom of the enclosure 25 for introducing a liquid such as water to the drain hole 25' without splashing. The enclosure 25 is adapted to move back and forth together with the frame 21'.

It is important that the center of the wafer W align exactly with the rotary shaft 23' because the wafer W may otherwise be thrown off the disc 24 by the centrifugal force when the shaft 23' is rotated. For this reason, a pressing device 26 for pressing down the wafer W is attached immediately above the rotary shaft 23'. A movable member 27 for vertically moving by the operation of an air cylinder (not shown) is inside the pressing device 26, and a mounting piece 27' having a hole of the same shape as the wafer to be polished as shown in FIG. 2B is extended horizontally from the bottom of the movable member 27.

Figure 3B:
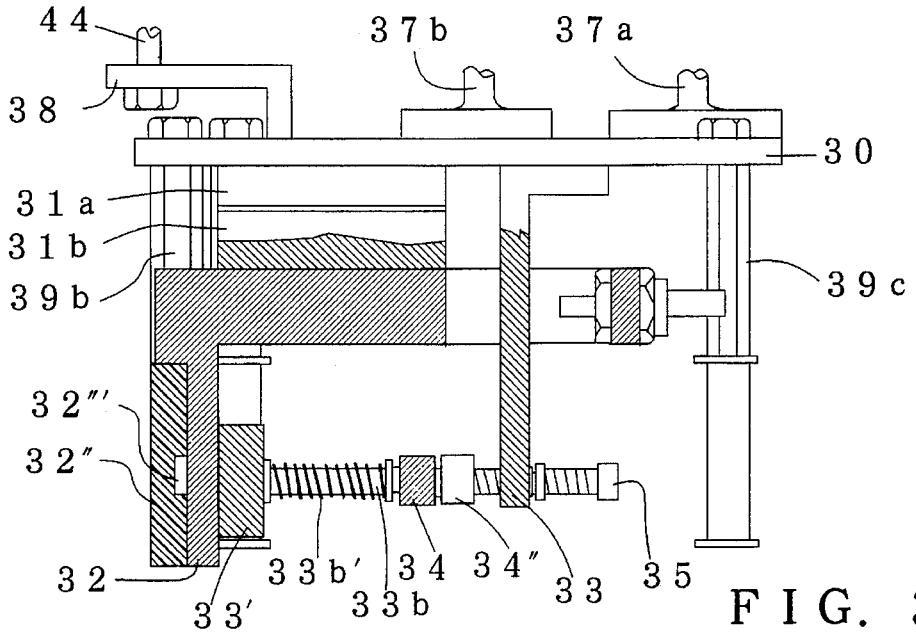
FIG. 3B is its plan view taken along line 3B—3B of FIG. 3A.
Figure 3A:
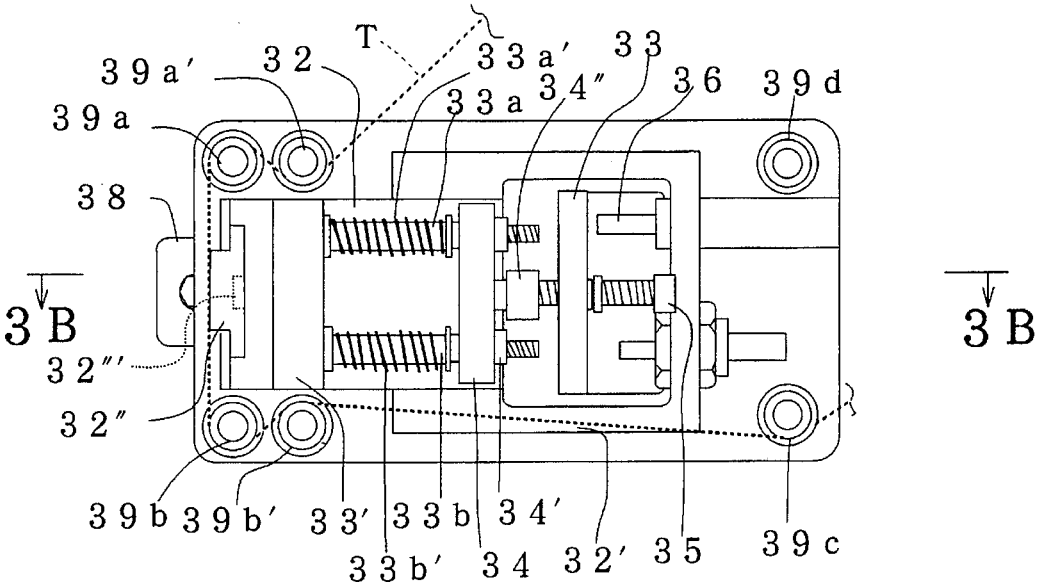
FIG. 3A is a front view of the polishing head of the polishing apparatus of FIGS. 1A and 1B.

As the air cylinder for the pressing device 26 is activated, the member 27 is moved downward until it comes to the position of the disc 24 of the rotating device 23 where the wafer W is put inside the hole of the plate 27' and on the disc 24. This is how the center of the wafer W is positioned exactly at the center of the disc 24. The indentation 24' on the disc 24 is evacuated by the operation of the pump such that the wafer W is kept in this position on the disc 24. Since the wafer W is thus aligned with the disc 24, it is not affected by the centrifugal force of the rotation. The wafer W is then moved to a position for polishing operation by operating the air cylinder of the moving mechanism 3. With reference next to FIGS. 3A and 3B, the polishing head 6 includes a first base plate 30 and a first L-shaped plate 32, connected to each other through mutually engaging mounting members **31*a* and 31*b* such that they are slidable parallel to each other. A vertically extending member 33 is affixed onto the first base plate 30. A C-shaped frame 32' (with an opening at the center) is mounted at the rear end (towards the right in FIGS. 3A and 3B) of the first L-shaped plate 32 parallel to the first base plate 30 such that the vertically extending member 33 extends through the opening of the C-shaped frame 32'. An elastic abrasive polishing pad 32" is attached to the front (towards the left in FIGS. 3A and 3B) of the first L-shaped plate 32, and a pressure sensor 32'" is buried and attached behind the pad 32"**.

The first L-shaped plate 32 has a fixed block 33' attached to its front part for supporting two screw rods **33*a* and 33*b* parallel to the first base plate 30 and directed towards the vertically extending member 33. Numeral 34 indicates a movable block having two throughholes through which the two screw rods 33*a* and 33*b* penetrate such that the movable block 34 can move along the rods 33*a* and 33*b*. Each of the screw rods 33*a* and 33*b* is surrounded by a spring 33*a'* or 33*b'* extended between the movable block 34 and the fixed block 33'. At the rear ends of the screw rods 33*a* and 33*b* are nuts 34' for preventing the movable block 34 from becoming pushed off the screw rods 33*a* and 33*b* by the force of the springs 33*a'* and 33*b'***.

Numeral 35 indicates an adjusting screw which engages with and perpendicularly penetrates the vertically extending member 33 towards the movable block 34. The tip of this adjusting screw 35 is in contact with a base member 34" attached to the back surface of the movable member 34 in the middle between the two rods **33*a* and 33*b*. Since the mounting members 31*a* and 31*b* are engaged to each other so as to be movable sideways, as explained above, the movable block 34 compresses the springs 33*a'* and 33*b'* if the adjusting screw 35 is advanced. The compressed springs 33*a'* and 33*b'* cause the first L-shaped plate 32 to move to the left until the vertically extending member 33 touches a stopper 36 provided on the C-shaped frame 32'**.

When the pad 32" is pressed to the right, the springs **33*a'* and 33*b'* push the pad 32" back to the left because the movable block 34 is prevented from moving further to the right by the adjusting screw 35**. This is how the tape T is pressed onto the target object at a prescribed pressure.

Figure 4:
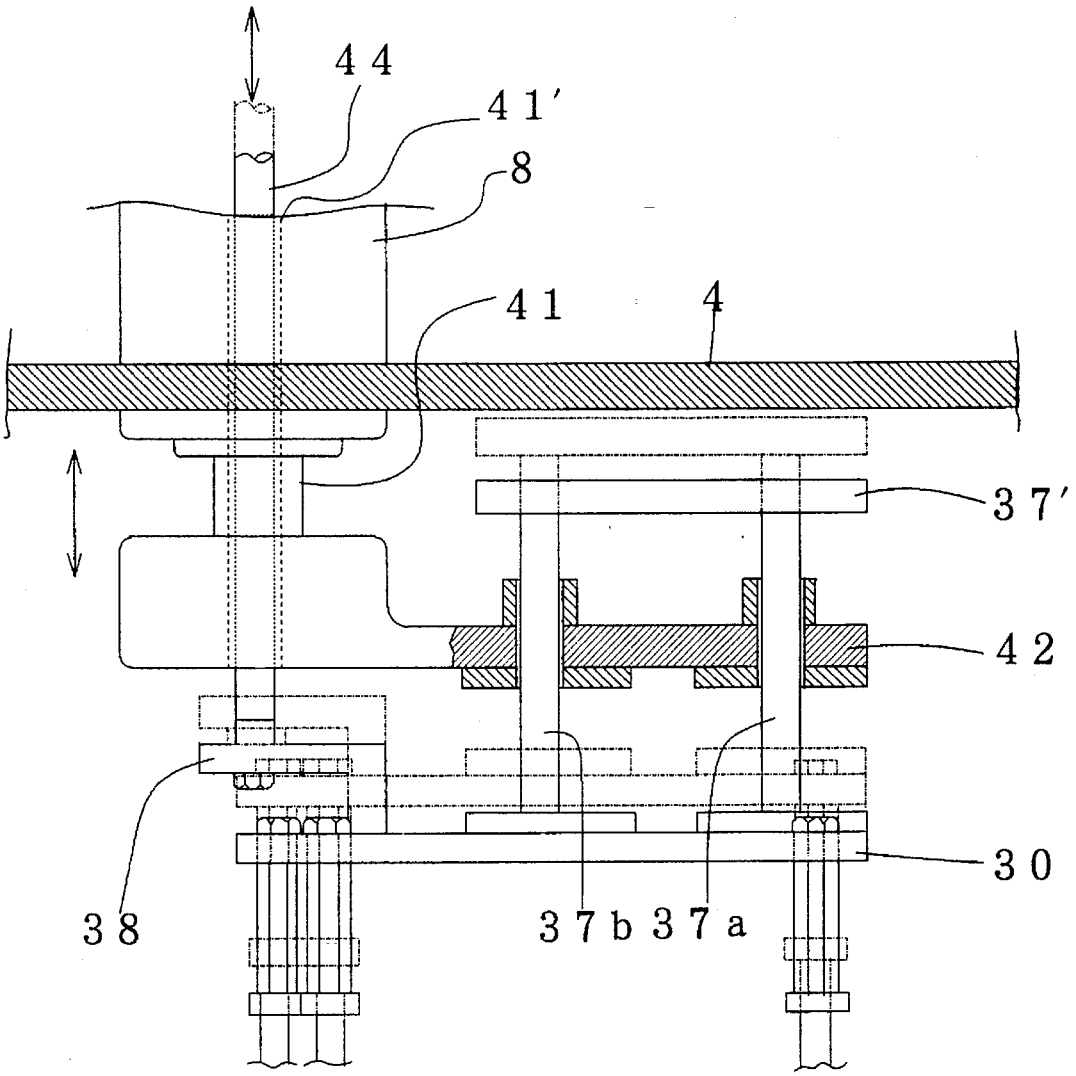
FIG. 4 is a plan view for showing the connection between the first base plate attached to the polishing head and the second base plate attached to the rotary shaft of the direct drive motor.

As shown in FIG. 3B, two rods **37*a* and 37*b* extend from the first base plate 30 opposite to the vertically extending member 33, and there is a second L-shaped plate 38 extending therefrom opposite to the first L-shaped plate 32. As shown in FIG. 4, the rotary shaft 41 of the motor 8 is attached to a second base plate 42. The second base plate 42 is provided with two throughholes, through which the rods 37*a* and 37*b* extend from the side of the first base plate 30 towards the front plate 4. The tips (distal from the first base plate 30) of the rods 37*a* and 37*b* are joined together by a stopper plate 37' for preventing the rods 37*a* and 37*b* from completely passing through and disengaging from the second base plate 42, as the first and second base plates 30 and 42** are caused to move towards or away from each other while remaining parallel to each other.

With reference again to FIG. 3A, pairs of upper and lower rods **39*a* and 39*a'*, 39*b* and 39*b'*, are attached perpendicularly to the first base plate 30 near its front end, and another pair 39*c* and 39*d* near its back end. These rods are for defining a travel path for the tape T, and are provided with tubular rollers (not shown) which are rotatable therearound such that the tape T can smoothly travel along the path defined by those rods as shown by a dotted line. The rollers around the backward rods 39***c* and 39*d* serve to prevent the tape T from coming into contact with the polishing head 6 as the latter is angularly oscillated during a polishing operation (to be explained more in detail below with reference to FIG. 7).

Figure 5:
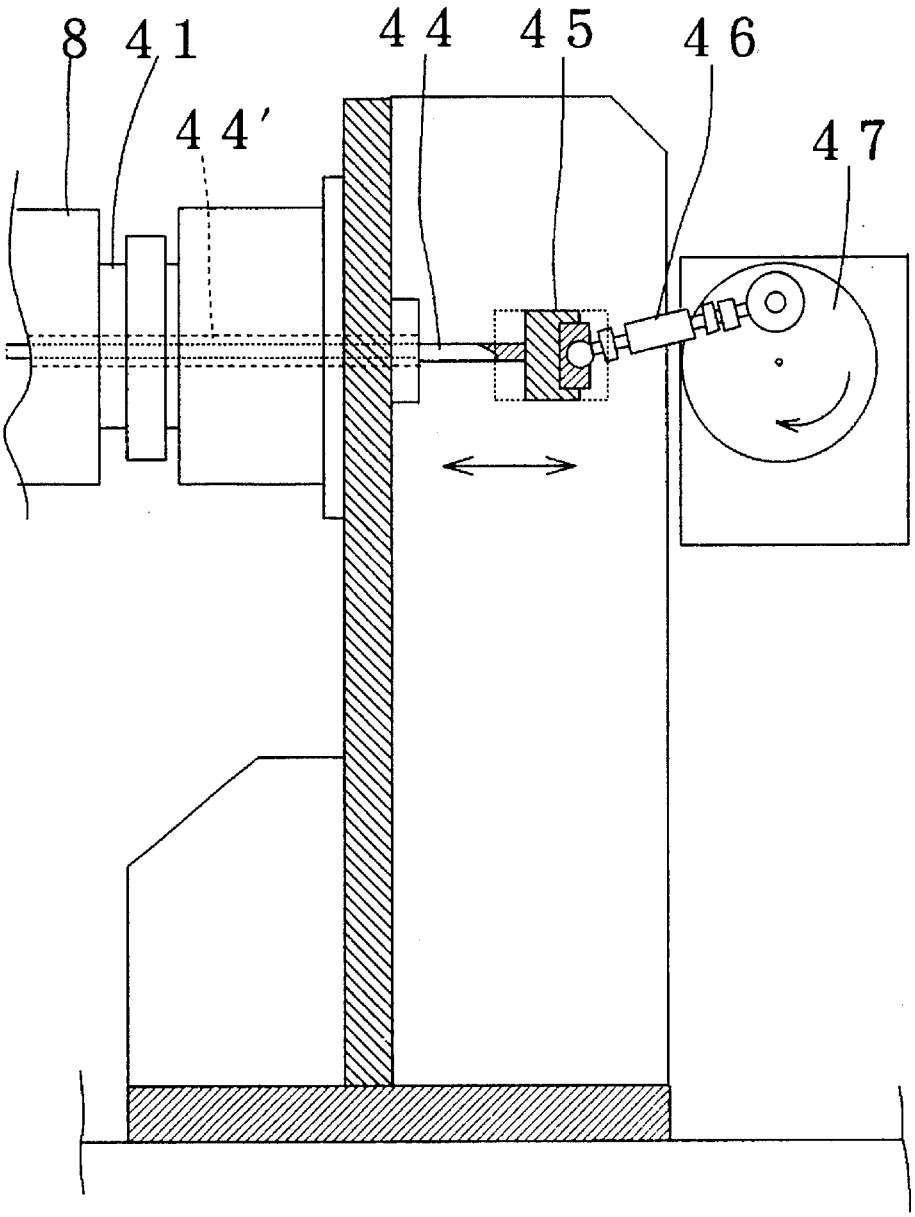
FIG. 5 shows the reciprocating means of the apparatus.

As shown in FIGS. 4 and 5, the rotary shaft 41 of the direct drive motor 8 is characterized as having an axially extending throughhole 41' formed therethrough and having another shaft (herein referred to as the inner shaft 44) passed therethrough. One end of this inner shaft 44 is perpendicularly affixed to the second L-shaped plate 38 attached to the first base plate 30. As will be explained below, the pad 32" is adapted to oscillate around an axis at its front surface. For this purpose, the inner shaft 44 is aligned with the front surface of the pad 32".

FIG. 5 shows a mechanism for causing the aforementioned oscillatory linear reciprocating motion, comprising essentially a universal joint 45 connected to one end of the inner shaft 44, a link 46 and a rotary plate 47. One end of the link 46 is rotatably attached to a peripheral point on the rotary plate 47 which is adapted to be rotated by a motor (not shown). A sphere is formed at the other end of the link 46 and is enveloped by the universal joint 45. With the mechanism thus formed, the inner shaft 44 can both rotate around its axis and execute an oscillatory motion in the longitudinal direction. Such a rotational motion of the inner shaft 44 is generated when the polishing head 6 undergoes an oscillatory motion together with the second base plate 42. It may be noted that the universal joint 45 of FIG. 5 may be replaced by a cam if the inner shaft 44 is not rigidly but rotatably connected to the second L-shaped plate 38. As the rotary plate 47 is rotated, the inner shaft 44 undergoes a longitudinal linear reciprocating motion through the rotary shaft 41 of the motor 8, thereby causing the first and second base plates 30 and 42 to move away from and towards each other while remaining parallel to each other. In other words, the second base plate undergoes a reciprocating motion perpendicularly to its surface.

Figure 6:
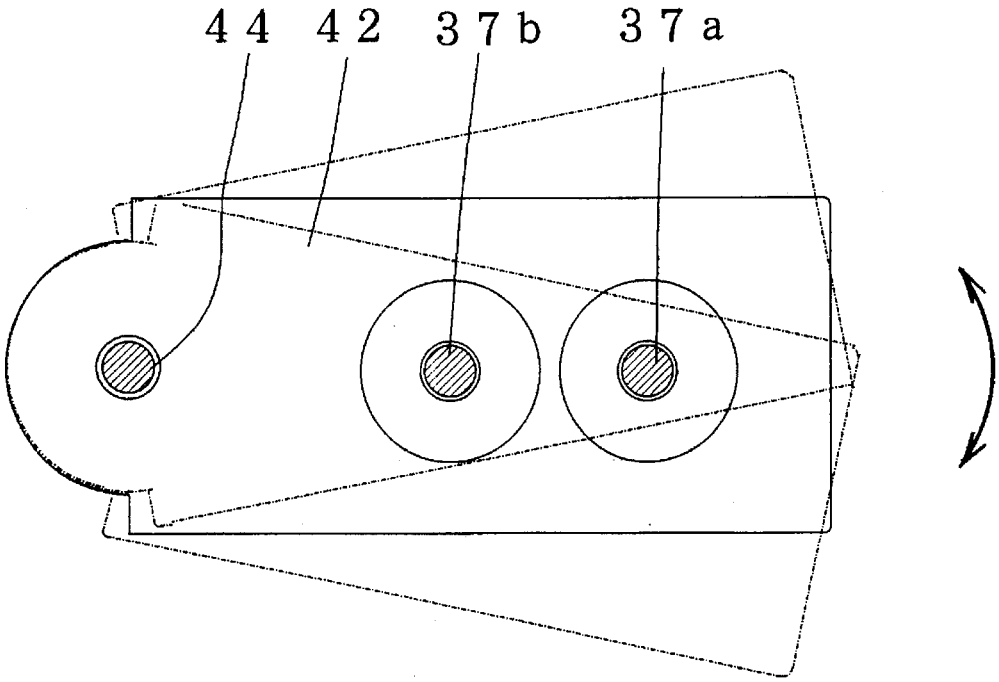
FIG. 6 shows the angular oscillatory motion of the second base plate connected to the direct drive motor.

FIG. 6 shows the motion of the second base plate 42 due to the operation of the motor 8. As explained above, the direct drive motor 8 is capable of not only rotating continuously by any specified angle in either direction but also rotating back and forth between two specified angular positions. Thus, if such angular positions are specified, the second base plate 42, attached to the rotary shaft 41 of the motor 8, can be rotated back and forth as shown by dotted lines in FIG. 6. Since the first and second base plates are connected by the rods 37*a* and 37*b* serving as connecting means, the first base plate is also caused to reciprocatingly swing around the rotary shaft 41. In other words, the polishing head 6 can be thus caused to undergo an angularly oscillating motion.

In what follows, operations of the apparatus 1 described above will be explained for the polishing of peripheral edge surfaces of a semiconductor wafer. After the moving mechanism 3 is moved to the mounting position as shown in FIG. 2A, the pressing device 26 is activated so as to lower the mounting piece 27' to the level of the wafer-holding disc 24, and the wafer W is placed inside the mounting piece 27' so as to match the shape of the hole in the piece 27'. Since the orientation flat of the wafer W is facing the backward direction opposite to the polishing head 6, as shown in FIG. 2B, the edges of the orientation flat are polished first. As the pump is activated, a negative pressure is created inside the indentation 24' of the disc 24 such that the wafer W is securely maintained on the disc 24. As the air cylinder of the mechanism 3 is activated, the waver W is moved to the position of the polishing head 6 as shown in FIGS. 1A and 1B. In the meantime, the polishing tape T is advanced from the supply roller 10 and travels to the take-up roller 11 through the rollers 12, 13*a*, 13*b* and 13*c* as well as the polishing head 6. During this time, the contact pressure between the tape T and the wafer W is monitored by the pressure sensor 32'" and is adjusted to a specified level by means of the adjusting screw 35.

During the polishing, furthermore, a liquid such as water, which is required for the operation, is supplied to the polishing region through the pipe 7 with its tip made flexible for the convenience of application of the liquid. At this moment, the polishing head 6 is positioned as shown in FIG. 7B with the tape T oriented perpendicularly to the main surfaces of the wafer W. The liquid used for the polishing operation and dust particle generated thereby are collected inside the enclosure 25 and discharged together therefrom. After the dust particles are removed, the collected liquid is discharged without undergoing any treatment process.

In order to improve the efficiency of the polishing by causing the polishing head 6 to undergo a linear reciprocating motion, the rotary plate 47 may be rotated so as to cause the inner shaft 44 to undergo a periodic oscillatory motion. This causes also the first base plate 30 and the tape T to move reciprocatingly transversely to the direction in which the tape T is supplied such that always different parts of the tape T come into contact with the wafer W and the polishing can be carried out more effectively.

Figure 7A:
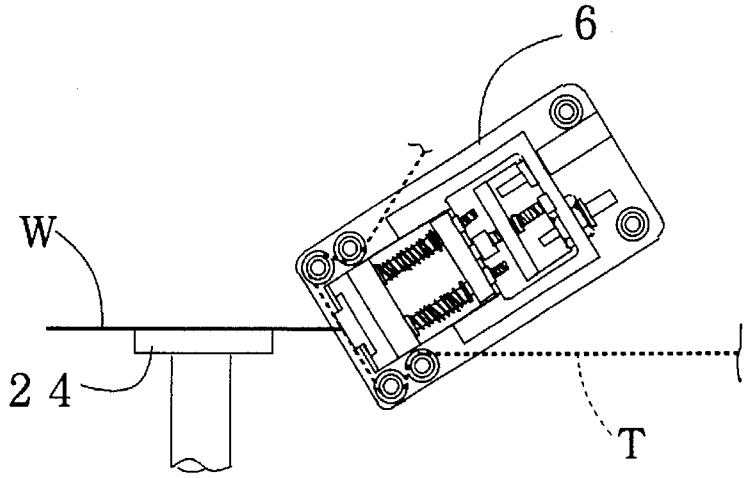
FIGS. 7A, 7B and 7C show the oscillatory motion of the polishing head.
Figure 7B:
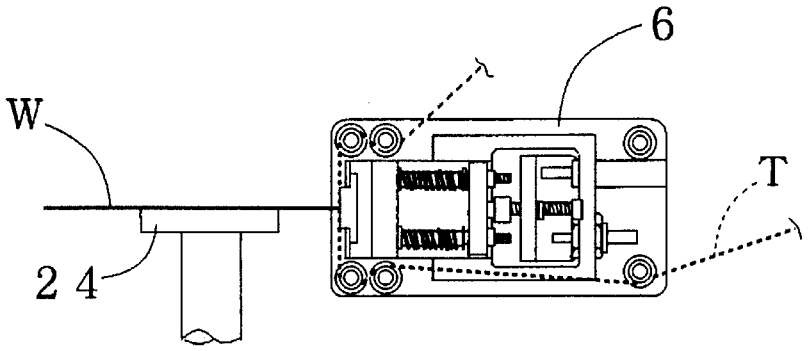
Figure 7C:
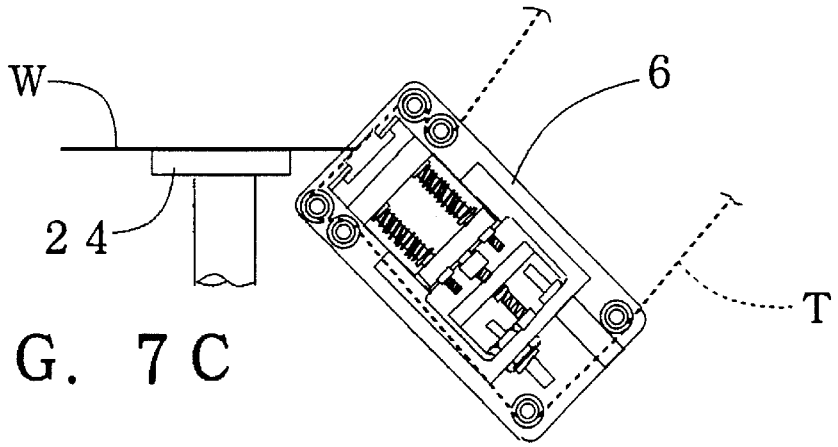

When it is desired to contact the tape T obliquely to the wafer W at a specified angle (other than 90 degrees), the direct drive motor 8 is activated to rotate the rotary axis 41 according to a desired angle of contact as shown in FIG. 7A or 7C. Alternatively, the angle of the motor 8 can be reciprocally changed back and forth (say, from the position of FIG. 7A to that of FIG. 7C and then backward). In this manner, the periphery of the wafer W can be polished in a rounded cross-sectional shape. When the entire periphery of the wafer W is to be polished, the wafer-rotating motor 22 is activated to cause the wafer W to rotate around its own axis. In this operation, too, the polishing head 6 may be additionally caused to oscillate, or to undergo a linear reciprocating motion as explained above.

Because of the use of a polishing tape, the polishing apparatus according to the present invention does not require a slurry composed of abrasive grains and a solvent. As a result, there is no need for a washing process after the polishing and the discharge water does not have to be treated before being discarded. This contributes significantly to the reduction in the cost of the operation. Since the polishing head according to the present invention can undergo an oscillatory motion perpendicular to the direction of supply of the tape, the polishing operation can be carried out more effectively. A still further advantage of the apparatus according to the present invention is that the angle of contact between the polishing head and the target object can be easily changed.

What is claimed is:

1. In combination with a polishing tape, an apparatus for polishing an object with said tape, said apparatus comprising:

a motor having a rotary shaft which is tubular, having an axially extending throughhole therethrough;

an inner shaft slidably disposed inside said throughhole, both ends of said inner shaft protruding from said rotary shaft;

a first plate attached to one end of said inner shaft;

at least two guide rollers supported by said first plate for stretching said tape therebetween;

a second plate attached perpendicularly to said rotary shaft;

reciprocating means for moving said inner shaft reciprocatingly through said rotary shaft along said through-hole; and connecting means for connecting said first and second plates such that said first and second plates can move selectively towards or away from each other while remaining parallel to each other.

2. The apparatus of claim 1 wherein said motor is capable of rotating said rotary shaft by a specified angle in either direction and rotating said rotary shaft back and forth between two specified angular positions.

3. The apparatus of claim 1 wherein said reciprocating means comprises:

a rotary plate having a circumference away from an axis of its rotation;

a link having a front end and a back end, said back end being rotatably connected to said rotary plate near said circumference; and a universal joint which connects the other end of said inner shaft and said front end of said link.

4. The apparatus of claim 1 wherein said connecting means includes rods which are connected perpendicularly to said first plate and penetrate said second plate through holes formed through said second plate.

5. The apparatus of claim 1 further comprising means for emitting a liquid where said tape contacts said object.

6. The apparatus of claim 1 further comprising:

a pad disposed between said two guide rollers movably with respect to said first plate;

pushing means for pushing said pad against said tape; and a pressure sensor disposed between said pushing means and said pad.

7. The apparatus of claim 1 further comprising means for supporting said object thereon and rotating said object.

* * * * *